United States Patent [19]
Johnson

[11] Patent Number: 4,472,461
[45] Date of Patent: Sep. 18, 1984

[54] METHOD FOR PRODUCING PERFORATIONS IN AN ADHESIVE-COATED POROUS WEB

[75] Inventor: David A. Johnson, Danvers, Mass.

[73] Assignee: The Kendall Company, Boston, Mass.

[21] Appl. No.: 395,529

[22] Filed: Jul. 6, 1982

[51] Int. Cl.[3] ..... B05D 5/10
[52] U.S. Cl. ..... 427/208.6; 427/207.1; 427/348
[58] Field of Search ..... 427/208.6, 207.1, 348

*Primary Examiner*—Bernard D. Pianalto
*Attorney, Agent, or Firm*—Frederick R. Cantor

[57] ABSTRACT

An apparatus and method is disclosed herein for producing controlled perforations in an adhesive-coated porous web. A porous, woven or nonwoven web backing material has an adhesive, or the like, coated onto a surface thereof, and prior to drying of the adhesive thereon, a gas, or the like, is directed through a gas perforating means, which incorporates a plurality of apertures therein. While said gas perforating means is variably positioned in contiguous proximity to the moving adhesive-coated porous web, the gas stream impinges on the adhesive-coated porous web, resulting in a plurality of discontinuities or perforations being formed in the adhesive-coated porous web. Various predetermined patterns of perforations in the adhesive-coated web may be obtained by oscillating the gas perforating means in different directions, altering the physical dimensions of the apertures located in the gas perforating means, altering the spatial pattern of said openings, rotating the gas perforating means during the operation, and the like.

15 Claims, 8 Drawing Figures

FIG. 3. C

METHOD FOR PRODUCING PERFORATIONS IN AN ADHESIVE-COATED POROUS WEB

BACKGROUND OF THE INVENTION

The present invention relates to improvements in an apparatus for and a method of making perforated adhesive tapes.

The present invention further relates to an apparatus for and a method of producing controlled perforations in an adhesive-coated porous web, and most particularly relates to an apparatus for and a method of utilizing controlled gas streams in order to produce desired perforation patterns in adhesive-coated porous webs.

The need for adhesive-backed tapes incorporating a myriad of relatively fine perforations for various applications, has been felt for a long time.

Cloth tapes comprising a porous backing of woven materials, such as cotton, or the like, and coated with a pressure-sensitive adhesive, have found wide applicability in both the medical and electrical fields.

In the medical field, adhesive-backed cloth tapes are widely used currently to mechanically retain bulky medical dressings or medical appliances used for therapeutic or monitoring purposes on the body of the patient.

In the electrical field, adhesive-backed non-conductive cloth tapes are used to isolate and/or insulate groupings of electrical wires or electrical components.

Adhesive-backed woven cloth tapes are preferred in many cases to tapes having nonwoven backings, because of their inherent greater tensile strength and elongation properties, which permit substantially more pressure to be applied to the tape without its stretching. Cloth tapes offer the additional advantage of being fairly easily tearable in a straight line, normally along or across one or another lines of the weave. This feature is especially desirable when scissors or other cutting implements are not readily available.

The presence of perforations in the adhesive-backed tapes which are produced by the apparatus and process of the present invention, will also facilitate the tearing factors discussed above in some applications.

In a medical setting, when it is expected that the adhesive-coated tape will be in place for an extended period of time, the use of perforations will enable this long term adhesion to be achieved by allowing moisture accumulated under the applied tape to readily evaporate.

The conventional prior art techniques designed to incorporate perforations in adhesive-backed tapes, have usually utilized an apparatus which embodies a perforating element carrying a plurality of needle-like points, or the equivalent, which are positioned so as to mechanically impinge upon the adhesive-backed tape during its manufacture shortly after the application of the adhesive coating thereon, so as to perforate both the tape web backing as well as the adhesive coating applied thereon.

One of the more serious drawbacks of such a prior art apparatus and method, has been the need to embody a means to insure the setting or hardening of the adhesive coating sufficiently rapidly in order to prevent a tape back flow thereon as the perforating needle-like points are withdrawn, that would then result in a closing off of the perforations.

A further drawback to the mentioned prior art devices, has been the need for incorporating a means to both automatically and continually clean the perforating needle-like points after each penetration of the tape backing material and the associated adhesive coating.

The applicant has thus surprisingly found that the instant invention, which utilizes a controlled or regulated gas flow pressure, as well as a precisely directed gas flow, results in a predetermined discrete perforation pattern in an adhesive-coated porous web, that further eliminates the above-described serious drawbacks found in the prior art techniques.

SUMMARY OF THE INVENTION

It is therefore an object of the instant invention to provide both an apparatus and a method for producing controlled discrete perforations in an adhesive-coated porous web.

It is a further object of the instant invention to provide an apparatus and a method utilizing a controlled gas stream in order to produce desired perforation patterns in an adhesive-coated porous web.

It is, therefore, yet another object of this invention to provide an apparatus and a method for producing desired perforation patterns in an adhesive-coated porous web, that is at once simple to use, economical to operate, and free of the prior art limitations.

In accordance with the present invention, there is provided both a process and an apparatus for producing predetermined perforations in an adhesive-coated porous web. The process comprises orienting a moving adhesive-coated porous web backing into close coplanar proximity with the peripheral surface of a gas perforating means, said surface having a plurality of discrete gas openings or outlets incorporated therein, then directing controlled gas streams through the gas perforating means openings, thereby impacting onto discrete regions of the contiguously oriented adhesive-coated porous web, and resulting in the formation of a plurality of discrete perforations in the adhesive-coated web, at predetermined positions thereon.

The apparatus for the production of the desired perforations in an adhesive-coated porous web, comprises an essentially cylindrical, elongated, hollow structure, having a plurality of essentially small size openings incorporated in the peripheral surface thereof, the openings serving to direct gas, or the like, under pressure onto the surface of an essentially moving, contiguous and coplanarly oriented, adhesive-coated porous web, resulting in the production of a plurality of discrete perforations or openings thereon, at the sites of gas contact. Various adhesive-coated web perforation patterns are obtained by alternate arrangements of the openings in the gas perforating means and/or by varying the movements, in one or more directions, of the separately mounted gas perforating means.

Generally speaking, these and other objects of the instant invention are realized as described herein in a method and apparatus for producing desired patterns of controlled perforations in an adhesive-coated porous web.

BRIEF DESCRIPTION OF THE DRAWINGS

In order that the present invention be more readily understood, and so that the further presented features thereof may be appreciated, the invention will now be described by way of example with reference to the accompanying drawings, in which:

FIGS. 3A to 3E are top plan views depicting several representative perforated adhesive-coated porous tape web patterns obtained by utilizing an exemplary embodiment of the present invention.

DETAILED DESCRIPTION OF THE PREFERRED EMBODIMENT

Figure 1:
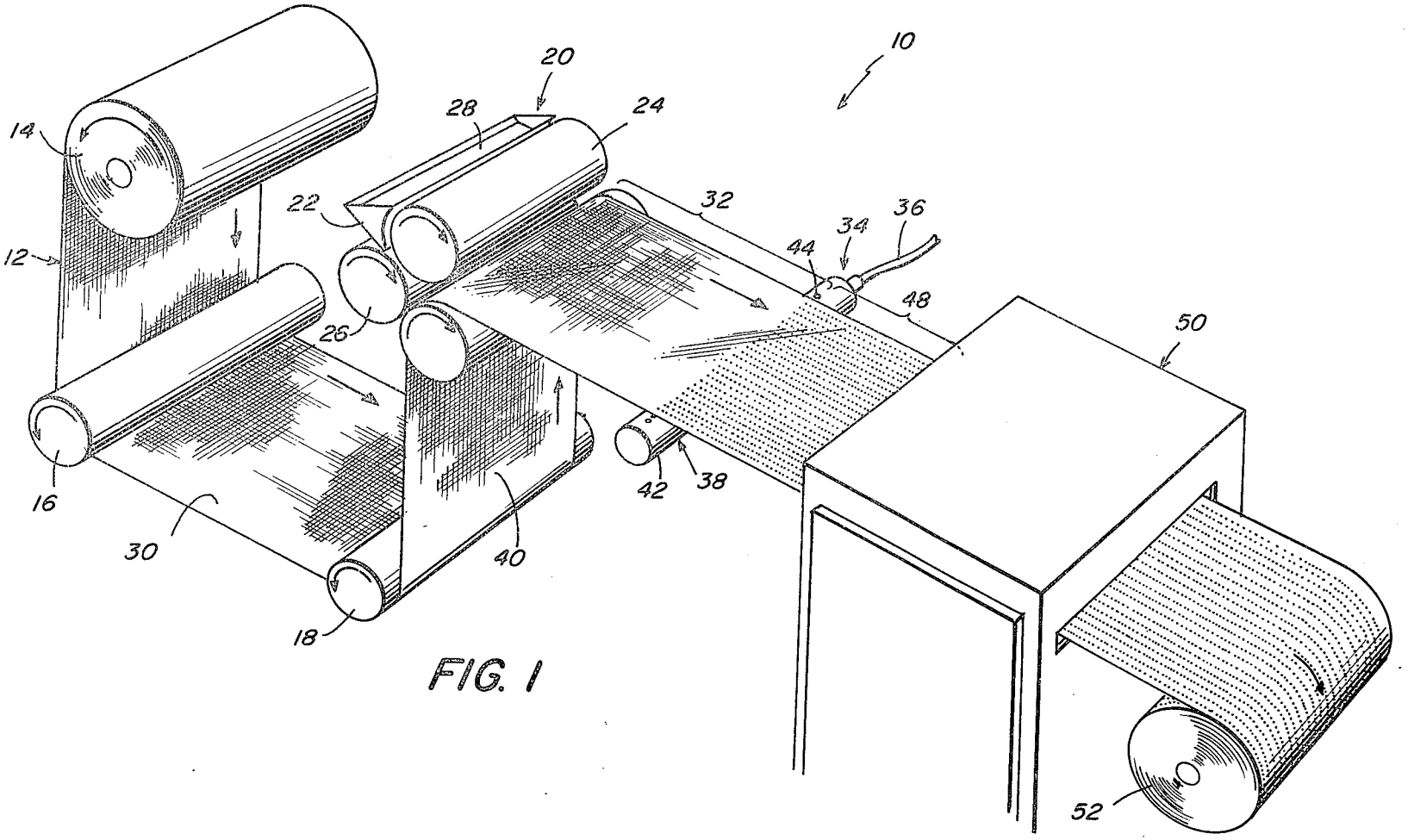
FIG. 1 is a diagrammatical side and top elevational view of an adhesive tape making and gas perforating apparatus incorporating an exemplary embodiment of the present invention.

Referring now to FIG. 1 which is a diagrammatic side and elevational view of the perforated adhesive tape-making apparatus incorporating an exemplary embodiment of the present invention.

As shown in FIG. 1, the adhesive tape-making and perforating apparatus of the present invention is depicted generally as 10. A substantially porous web 12, initially uncoated, is shown being unwound from a web storage roll 14. The porous web 12, may be a substantially porous woven or nonwoven material, or the like, being composed of material of either natural or synthetic origin. The direction of movement of the unwinding porous web 12, is depicted by the arrows shown overlayed on the porous web 12. Idler rollers, 16 and 18, both guide and facilitate the path of movement of the porous web 12, as it is being directed towards the adhesive coating station 20.

Also shown at the adhesive coating station 20, is an adhesive application trough 22. The adhesive application trough 22, serves as the site of introduction of a liquid adhesive material into the adhesive coating portion of the instant process, which adhesive may be a pressure sensitive adhesive, such as at 28, or the like.

Adhesive 28, which is substantially non-porous or non-permeable to a gas, is fed into the adhesive application trough 22, and then is automatically spread onto the surface of the adhesive application roller 24. The adhesive material 28, is then transferred to the adhesive coating roller 26, through its transfer by surface contact with the adhesive material 28, already coated onto the rotating adhesive application roller 24.

At this point in the process, the inner or roller-facing surface 30 of the moving, continuous porous web 12, is coated with the adhesive 28, as the porous web 12 moves into contact with the adhesive previously spread onto the adhesive coating roller 26. A region of the moving porous web 12, depicted herein as 32, defines the section of the moving porous web 12, having the recently applied, and at this point still liquid, adhesive material 28, that has been previously coated onto the inner roller-facing surface 30, of the moving porous web 12.

Figure 2:
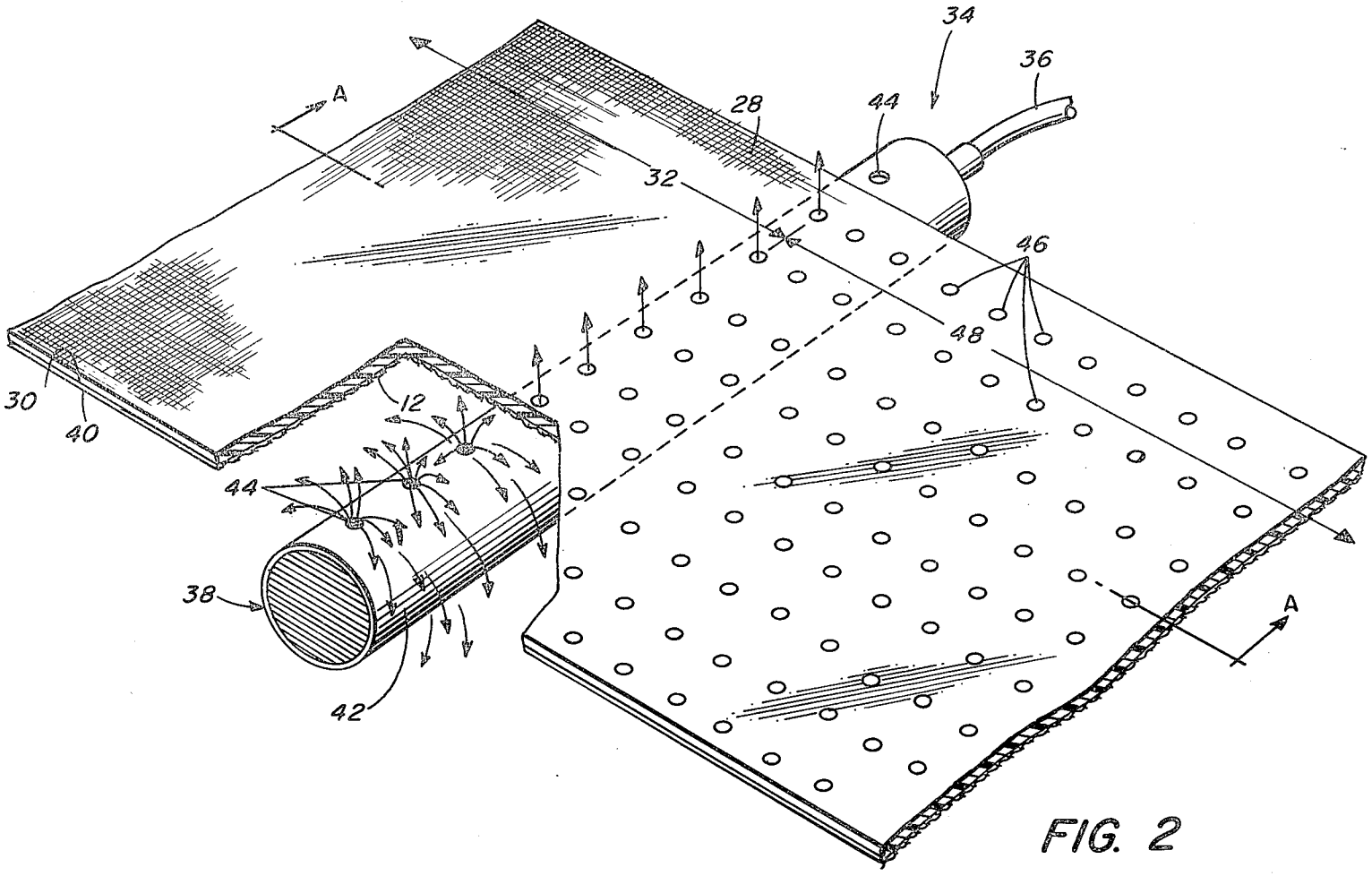
FIG. 2 is an enlarged fragmentary top plan view showing a partially cut away portion of the gas perforating means of an exemplary embodiment of the present invention, as well as perforated and non-perforated segments of an adhesive-coated porous web.
Figure 3A:
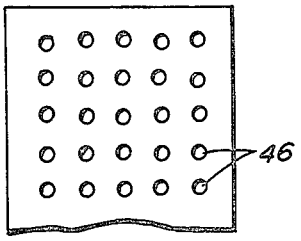
Figure 3B:
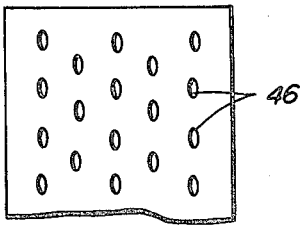
Figure 3D:
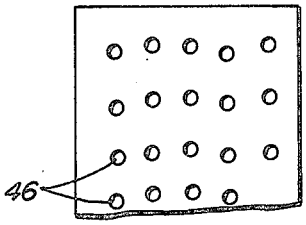
Figure 3D:
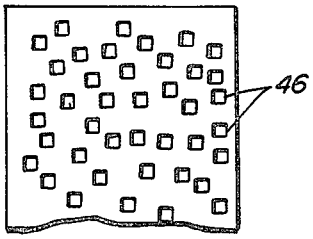
Figure 3E:
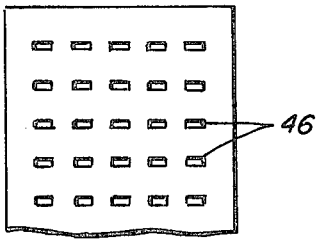

FIG. 2 is an enlarged fragmentary view of the invention showing a partially cut away portion of a gas perforating means, as well as perforated and non-perforated segments of the adhesive-coated porous web, for further explaining this invention.

The gas perforating means is depicted generally as 34. Any gas such as a suitable non-reactive liquid in its gaseous phase and including air and steam, is supplied under regulated and adequate pressure to the gas perforating means 34, via an attached gas supply tube 36, from an appropriate and conventional gas source (not shown). The gas directing tube 38 being the major portion of the gas perforating means 34, is an elongated, hollow, essentially cylindrical, tube-like structure, located in contiguous, substantially coplanar proximity to the under surface 40 of the porous web 12, and just slightly separated therefrom. It is to be noted that other configurations of the gas directing tube 38 are possible, if desired.

Incorporated within a generally linear segment and running the length of the peripheral surface 42, of the gas directing tube 38, is a plurality of spaced discrete openings, referred to as the gas directing openings 44, the function of which will be described at a later point in the specification.

Figure 4:
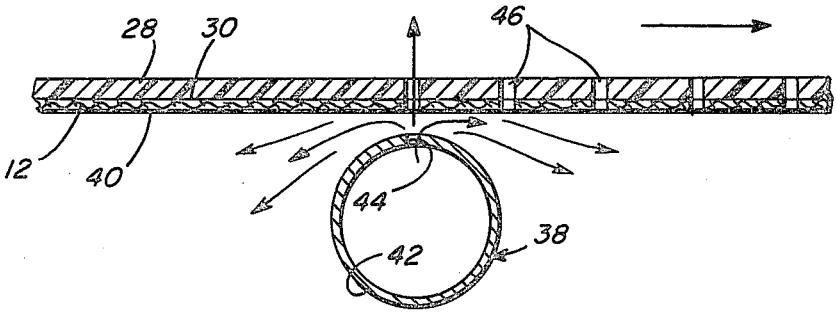
FIG. 4 is a cross-sectional view taken along lines A—A of FIG. 2 of an exemplary embodiment of the present invention.

FIG. 4 is a cross-sectional view taken along lines A—A of FIG. 2 of an exemplary embodiment of the present invention.

As seen in both FIGS. 2 and 4, gas, or the like, (arrows indicating gas flow), exiting under adequate and regulated pressure as described above from the plurality of the discrete openings 44, will move in either of several directions as depicted diagrammatically by the arrows in the above-mentioned FIGURES, which direction depends on the pressure of gas, the openings employed, the distance of web from the openings, etc.

It should also be noted at this time, that in the process herein being described, the adhesive-coated porous web 12, will be traveling at an appropriate continuous or interrupted process rate of speed, and will be oriented so that its non-adhesive-coated surface 40, will be slightly separated from, but in contiguous coplanar proximity to the peripheral surface 42, of the segment of the gas directing tube 38 that incorporates the openings 44.

The major component of each of the individual discrete gas streams (see again arrows in FIGS. 2 and 4), exiting from the plurality of openings 44, will travel essentially perpendicular to both the essentially linear segment of the peripheral surface 42 of the gas directing tube 38, incorporating the gas directing openings 44, and the contiguously oriented moving porous, and now, adhesive-coated web 12. At this point in the process, the adhesive coating 28 on the surface 30 of the porous web 12, still being in a liquid state, will be impinged upon or impacted by the emerging plurality of discrete gas streams or jets (see arrows) under pressure, resulting in a plurality of discontinuities or apertures 46, being formed in the gas jet-impacted region of the adhesive-coated web, indicated as region 48 in FIGS. 1 and 2.

The multiple discrete gas stream or jets emerging from the plurality of individual openings 44 will, for the most part, impinge or impact directly upon, and then dislodge multiple discrete "target" or impact regions of adhesive coated on the porous web 12. In so doing, individual, cleanly demarcated perforations or apertures 46, are formed in the adhesive-coating 28, at the site of each gas jet impingement, by gas being forced through the substantially continuous adhesive-coating 28 adhered to the porous web 12. The adequate, regulated gas pressure utilized in the instant process to perforate the adhesive 28, is determined by the nature of the thickness and consistency of the particular adhesive 28 applied thereto, as well as by the relative gas porosity of the web material itself. The remaining portion of the plurality of individual gas stream jets, (see arrows in FIGS. 2 and 4), emerging from the openings 44, will travel substantially coplanar to and along the under surface 40 of the moving porous web 12, in an essentially laminar configuration. This gas flow pattern, i.e. the gas portion not resulting in perforations, results in the formation of a laminar area of reduced ambient air pressure contiguous to and coplanar with the under surface 40 of the porous web 12. This reduced ambient air pressure region, substantially causes the adhesive-coated porous web 12 to remain in substantially contiguous coplanar proximity to the peripheral surface 42 of the gas directing tube 38, instead of being pushed upward and "floating" away from the gas directing tube 38. This, maintaining of the proximity between the adhesive-coated porous web 12, and the openings 44 greatly aids in the aperture-producing phase of the instant process.

At this point in the process, the moving, now gas-perforated adhesive-coated porous web 12, continues along its process path and passes through a conventional convection oven 50, where a curing or congealing of the adhesive coating 28 occurs within a very brief time interval. The discrete, cleanly demarcated borders of the apertures or perforations 46, are now maintained, in part due to the rapid curing of the perforated coated adhesive mass 28, following the gas jet formation of the plurality of apertures 46 therein. The controlled and regulated pressure of the gas jet streams, (indicated by the arrows), and discussed supra, emanating from each of the openings 44, aids in both the formation of the apertures 46, in the adhesive-coated porous web 12, as well as their cleanly demarcated edges. Upon exiting from the interior of the convection oven 50, the now perforated and dry adhesive-coated tape web is finally wound up onto an adhesive tape take-up spool 52.

FIGS. 3A to 3E are top plan views depicting several perforated adhesive-coated porous tape web patterns obtained by utilizing exemplary embodiments of the present invention. It should be noted that the depicted perforation patterns are only representative illustrative examples, of an almost infinite number of such patterns possible by alteration of several of the following process conditions.

The openings 44 may have different aperture configurations, thereby resulting in different geometrically configured perforations or apertures 46 in the perforated adhesive-backed porous tape web.

Also, the gas directing tube 38, itself may be utilized in either a fixed position during the process, or it may be oscillated intermittently or continuously during the course of the process. It is also possible to create continuous slots or grooves in the adhesive coating of the web, by a suitable arrangement of the pattern or configuration of the openings 44, adjustments in the air flow, the web movement rate, and other similar adjustments.

The gas directing tube 38, also may be rotated or moved in other directions, either continuously or intermittently during the process, thereby resulting in the production of a further number of aperture patterns in the adhesive-coated web. Finally, the spatial array of the openings 44 incorporated within the gas conducting tube 38 may be altered, resulting in still a further number of aperture patterns in the perforated web.

The previous detailed description of the preferred embodiment of the present invention is given for purposes of clarity of understanding only, and no unnecessary limitations should be understood or implied therefrom, as such functions and equivalents may be obvious to those skilled in the art pertaining thereto.

What is claimed is:

1. A method of producing perforations in an adhesive-coated porous web, which comprises the steps of:
- imparting movement to a porous web;
- depositing an adhesive on said moving porous web;
- orienting said moving, porous web into substantially contiguous proximity to a gas perforating means:
- directing a regulated jet stream of gas through at least one opening in said gas perforating means;
- impinging said gas jet stream into contact with at least one adhesive region of said moving, porous web, and the velocity of said jet stream of gas being sufficient to cause displacement of said adhesive in said gas impinged regions of the porous web, thereby resulting in discrete discontinuities in the adhesive-coating thereon.

2. A method of producing perforations in an adhesive-coated porous web according to claim 1, wherein said gas perforating means has a plurality of openings incorporated therein, thereby resulting in a plurality of discrete discontinuities in said adhesive coating thereon.

3. A method of producing perforations in an adhesive-coated porous web according to claim 1 or claim 2, wherein said discrete discontinuities are substantially apertures.

4. A method of producing perforations in an adhesive-coated porous web according to claim 1 or claim 2, wherein said discrete discontinuities are substantially groove-like.

5. A method of producing perforations in an adhesive-coated porous web according to claim 1 or claim 2, wherein said gas is air.

6. A method of producing perforations in an adhesive-coated porous web according to claim 1 or claim 2, wherein said gas is steam.

7. A method of producing perforations in an adhesive-coated porous web according to claim 1 or claim 2, wherein said gas is a suitable non-reactive liquid in a vapor state.

8. A method of producing perforations in an adhesive-coated porous web according to claim 1 or claim 2, wherein said adhesive is a pressure sensitive adhesive.

9. A method of producing perforations in an adhesive-coated porous web according to claim 1 or claim 2, wherein said adhesive-coating is substantially non-porous to a gas.

10. A method of producing perforations in an adhesive-coated porous web according to claim 1 or claim 2, wherein said porous web material is a woven material.

11. A method of producing perforations in an adhesive-coated porous web according to claim 1 or claim 2, wherein said porous web material web is a nonwoven material.

12. A method of producing perforations in an adhesive-coated porous web according to claim 1 or claim 2, wherein said web material is substantially porous to a gas.

13. A method of producing perforations in an adhesive-coated porous web, according to claim 1, wherein said porous web is a natural material.

14. A method of producing perforations in an adhesive-coated porous web according to claim 1, wherein said porous web is a synthetic material.

15. A method of producing perforations in an adhesive-coated porous web according to claim 1 or claim 2, wherein said gas perforating means is oscillating.

* * * * *